United States Patent [19]

Pötzsch

[11] Patent Number: 4,693,183

[45] Date of Patent: Sep. 15, 1987

[54] TRACK SYSTEM FOR A PASSENGER-ACCOMMODATING VEHICLE AS PART OF A ROLLERCOASTER

[76] Inventor: Georg Pötzsch, Westendstrasse 121, D-8000, München 2, Fed. Rep. of Germany

[21] Appl. No.: 808,123

[22] Filed: Dec. 12, 1985

[30] Foreign Application Priority Data

Dec. 21, 1984 [DE] Fed. Rep. of Germany ..... 3446951

[51] Int. Cl.[4] ..... A63G 21/10

[52] U.S. Cl. ..... 104/55; 104/63

[58] Field of Search ..... 104/53, 55, 56, 63, 104/69, 57

[56] References Cited

U.S. PATENT DOCUMENTS

| | | | |
|---|---|---|---|
| 429,601 | 6/1890 | Bormann | 104/56 |
| 780,049 | 1/1905 | Maguire | 104/63 |
| 1,337,873 | 4/1920 | Zeman | 104/57 |
| 1,805,266 | 5/1931 | Traver | 104/63 |
| 3,889,605 | 6/1975 | Bacon | 104/56 |
| 4,394,173 | 7/1983 | Aste | 104/69 |

FOREIGN PATENT DOCUMENTS

| | | | |
|---|---|---|---|
| 853869 | 10/1952 | Fed. Rep. of Germany | 104/55 |
| 1478272 | 8/1969 | Fed. Rep. of Germany | 104/69 |
| 2504011 | 5/1978 | Fed. Rep. of Germany | 104/56 |
| 3001450 | 7/1980 | Fed. Rep. of Germany | 104/55 |
| 3117314 | 5/1982 | Fed. Rep. of Germany | 104/69 |
| 899468 | 5/1945 | France | 104/55 |

OTHER PUBLICATIONS

"Darda-Drom fur Darda Autos", Dec. 1978, (Koufhof Munchen Marrenblotz).

*Primary Examiner*—Randolph A. Reese

*Attorney, Agent, or Firm*—Armstrong, Nikaido, Marmelstein & Kubovcik

[57] ABSTRACT

A track system for a passenger-accommodating vehicle as a part of a rollercoaster comprising tracks which form an acceleration stretch, a rollover stretch consisting of several sections in which the vehicle is rotated around its lateral axis, two helical stretches in which the vehicle is rotated around its longitudinal axis, and a coasting stretch. The individual sections of the rollover stretches and the two helical stretches are arranged such that the form of the digit "Eight" results in a vertical projection of the track system.

14 Claims, 4 Drawing Figures

TRACK SYSTEM FOR A PASSENGER-ACCOMMODATING VEHICLE AS PART OF A ROLLERCOASTER

BACKGROUND OF THE INVENTION

1. Field of the Invention

The invention pertains to a track system for a passenger-accomodating vehicle as part of a rollercoaster comprising an accelerating stretch, a rollover stretch, helical stretches and a coasting stretch.

2. Description of the Prior Art

A rollercoaster designated as "corkscrew" is known from the German Auslegeschrift No. 2 504 011, in which the downward or drop path, on which the vehicles move downwardly by means of their own weight, is formed as a helix with a specific radius towards the longitudinal axis of the path and with a definite helix angle. By this means the vehicles also carry out, in addition to their forward movement, another movement which is designated in airplane stunt flying as a "roll".

Furthermore, a rollercoaster or slide can be taken from the German Offenlegungsschrift No. 3 117 314, especially for the use as a ride with unsteered vehicles, in which the radii of curvature of the track system can be changed to correspond to a clothoid spiral. This measure, already known also in the construction of streets and railroads, is supposed to guarantee that the vehicles move free of transverse force on a theoretically correct, spatial path.

In the brochure "Darda-Drom für Darda Autos" tracks for toy cars are described in which two rollover stretches are arranged between an acceleration stretch and a coasting stretch such that the two rollover stretches are positioned—apart from the absolutely necessary side-wise displacement—in a vertical plane. The axes of the two rollover stretches lie, however, adjacent to each other in a horizontal plane. The two rollover stretches are connected with each other by a horizontal run.

A track system for a passenger-accomodating vehicle as a part of a rollercoaster of the given kind can be taken from the German patent specification No. 3 001 450 and has tracks which form an acceleration stretch, a straight drop stretch, for example, or a kind of catapult, a rollover stretch consisting of several portions in which the vehicle is rotated around its own lateral axis, two helical stretches in which the vehicle is rotated around its longitudinal axis, and a coasting stretch. This system of tracks combines thus a helix with a rollover stretch so that a type of track results designated also as "Looping".

The disadvantage, however, of such a system of tracks is that, because of the complicated form of the path, the passing spectators cannot follow the vehicles along the complete stretch, thus these spectators are not animated to the desired extent to take a ride.

Furthermore, the attraction of such a rollercoaster wears out relatively fast, that means one has to continually attempt to attract visitors by offering new and even more complicated track forms.

SUMMARY OF THE INVENTION

The invention is based therefore on the object to provide a system of tracks for a passenger-accomodating vehicle as a part of a rollercoaster of the given kind, which on the one hand makes the observation of the complete and the most interesting part of the run by the spectators possible and on the other hand also ensures a new experience in rollercoaster rides.

This is achieved by the fact that the individual portions of the rollover stretches and the two helical stretches are arranged such that they form the shape of the digit "Eight", seen in a vertical projection of the track system.

Expedient embodiments are defined by the features in the dependent claims.

The advantages obtained by the invention are based on the fact that the curve of the path in the vertical track design has the form of a lying or a standing digit "Eight", by means of which a new effect results which causes an even greater enjoyment of the ride than with the multiple looping.

To make the easy transition from a rollover stretch to the helical stretches possible, the radii of the helical stretches are reduced gradually, in accordance with a plane spiral curve which is designated as a "clothoid".

Such a rollercoaster can be easily constructed so that the visitors to fairgrounds passing by the rollercoaster can follow exactly the vehicles and thus the reactions of the passengers both in the rollover stretch as well as also in both helical stretches and are therefore animated to take a ride on this rollercoaster.

The necessary peak speed of the track system with the two rollover stretches positioned horizontally adjacent to each other amounts to about 90 km/h which can be attained with the highest point of the acceleration path being at about 33 m. This embodiment can be realized easily with individual track elements connectable to each other so that it is suited for mobile rollercoasters which can be assembled and disassembled easily and are especially suitable for temporary fairgrounds.

With the track system with the rollover stretches positioned vertically on top of each other the highest point of the acceleration stretch has to be at a height of about 50 m above the ground so as to attain the peak speed of about 110 km/h which is necessary to ride through the rollover stretches. This embodiment is therefore, as a rule, only suitable for stationary rollercoasters which need not be disassembled regularly and which stand permanently in attraction parks.

BRIEF DESCRIPTION OF THE DRAWINGS

The invention is illustrated in more detail below using working examples referring to the schematic drawings enclosed hereto. Shown are FIG. 1 a side view of a first embodiment of the track system for a rollercoaster, FIG. 2 a top view of the embodiment of the track system as according to FIG. 1, FIG. 3 a side view of a second embodiment of a track system for a rollercoaster, and FIG. 4 a top view of the embodiment of the track system as according to FIG. 3.

DESCRIPTION OF THE PREFERRED EMBODIMENT

Figure 1:
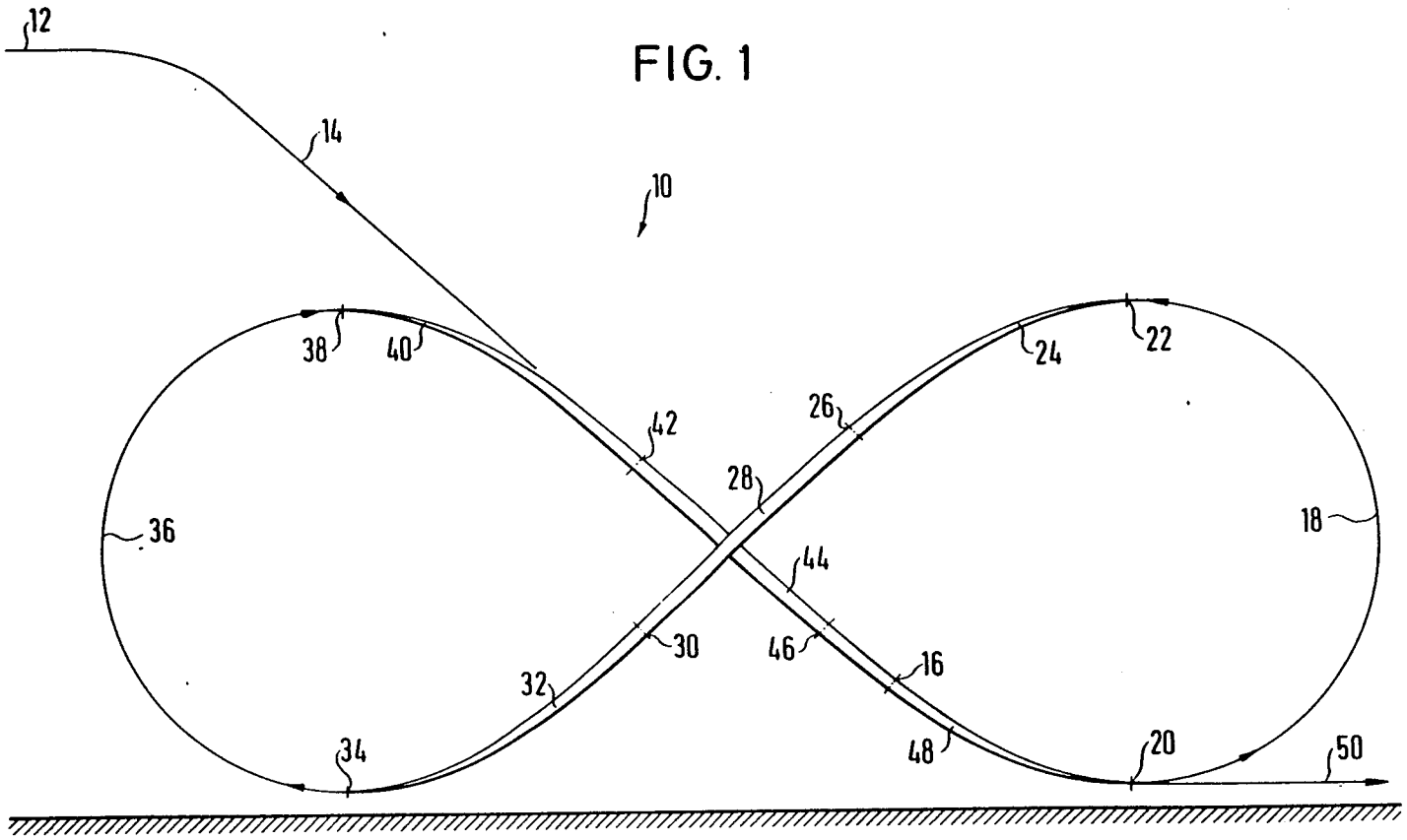

The track system for the passenger-accomodating vehicles of a rollercoaster shown in FIG. 1 and indicated generally by the reference number 10 begins at the highest point 12 of an acceleration stretch 14, which is about 33 m above ground. The vehicles can be brought to this highest point 12, for example, by a normal elevator stretch. It is also possible to exploit at least in part the kinetic energy of the vehicles which they still have after leaving the track system 10. Finally, there is also the possibility that the vehicles will again pass through the track system 10 in reverse direction so as to again arrive at the highest point 12 aided by an elevator stretch positioned on the accelerator stretch 14.

The tracks forming the track system 10, i.e. for example a single track or a double track, are carried by the usual steel supports (not shown) which are constructed according to requirement—just as are the tracks—so as to be disassembable.

The acceleration stretch 14 begins at the highest point 12, from which the tracks point downwardly in a straight line, that means without any turns, to the point 16. Thus, the vehicles move on this acceleration stretch 14 downwardly by their own weight and at a constantly increasing speed.

At point 16 the acceleration stretch 14 transfers into a first rollover stretch 18 which has approximately a semi-circular form.

At the lowest point 20 of the first rollover stretch 18 the vehicles reach a speed of about 90 km/h and ride then on the inner side of the rollover stretch 18 towards the top so that at the highest point 22 of the first rollover stretch 18 the heads of the passengers are pointed downwardly.

At the highest point 22 of the first rollover stretch 18 a first helical stretch, embodied as drop portion, begins. In this helical stretch, which extends approximately from the highest point 22 of the first rollover stretch 18, to a lowest point 34, the vehicles are turned at 180° around their longitudinal axis, that means that at the lowest point 34 the heads of the passengers are again point upwardly.

The helical stretch has a first helical section 24 which begins approximately at the highest point 22 of the first rollover stretch 18 and ends at the point 26. The radius of the first helical section 24 is defined by a clothoid, i.e. a plane spiral curve, the radius of curvature r of which is reversedly proportional at every point of its length to the arc length s to be measured from point zero of the coordinate system. A clothoid can be defined by the following equation:

$$r=A/s.$$

In the first helical section 24, for example, A=12.

A short, straight stretch 28 lying in a vertical plane and having a drop follows the end point, shown by no. 26, of the first helical section 24, which transfers at 30 into a second helical section 32. This helical section 32 is also defined by a clothoid with A=12.

At the lowest point 34 of the second helical section 32 a second rollover stretch 36 begins, at the highest point 38 of which the heads of the passengers are again directed downwardly.

At about its highest point 38 the second rollover stretch 36 transfers into a first helical section 40 which ends at 42 and is also defined by a clothoid with A=12. A straight stretch 44 lying in a vertical plane and having a drop follows the first helical section 40 with the beginning point at 42 and the end point at 46. This stretch 44 follows a second helical section 48 which is also defined by a clothoid with A=12. A coasting stretch 50 follows at the lowest point of the second helical section 48 which corresponds in the side view to the lowest point 20.

The two helical stretches 24, 28, 32 and 40, 44, 48, in which the vehicles are rotated each at 180° around their longitudinal axes, consist thus of, respectively, two helical sections 24, 32 or 40, 48, in which the vehicles are rotated in each at 90° around their longitudinal axes, and a straight stretch 28 or 44 with a drop, in which the tracks lie in a plane positioned at right angle to the ground. So as to still also produce in this area sufficient force for the vehicles and the passengers to press the passengers against their seats and the vehicle to the tracks, the straight stretches 28, 44 have a minor horizontal curvature, as can be recognized from the top view according to FIG. 2, so that the vehicles and thus also the passengers are pressed by this deviation from the straight movement by their forces of inertia against the tracks or against their seats. There is hence no danger in this area that the vehicles and the passengers could tip sidewise downwardly.

Figure 2:
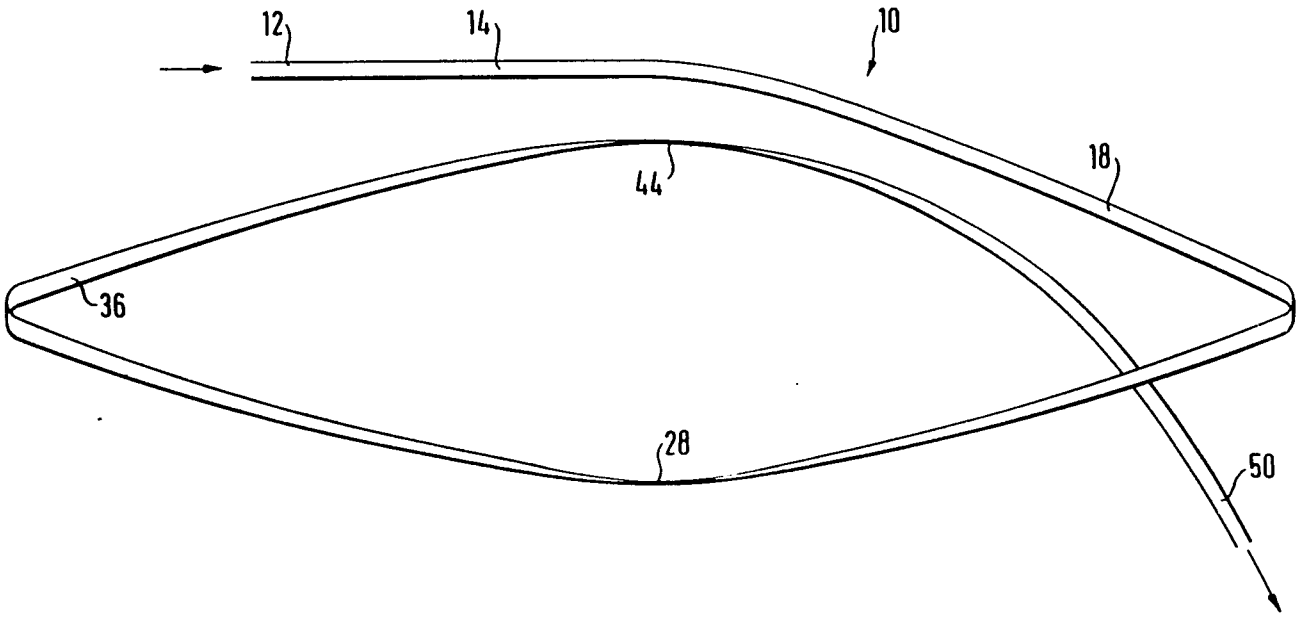

The two rollover stretches 18, 36 are positioned in the embodiment as according to FIGS. 1 and 2 in a horizontal direction adjacent to each other so that the form results of a horizontally lying digit "Eight". The highest point 12 of the accelerator stretch 14 is at about 33 m and the two highest points 22, 38 of the rollover stretches 18, 36 are about 21 m above the lowest points 20, 34.

Figure 3:
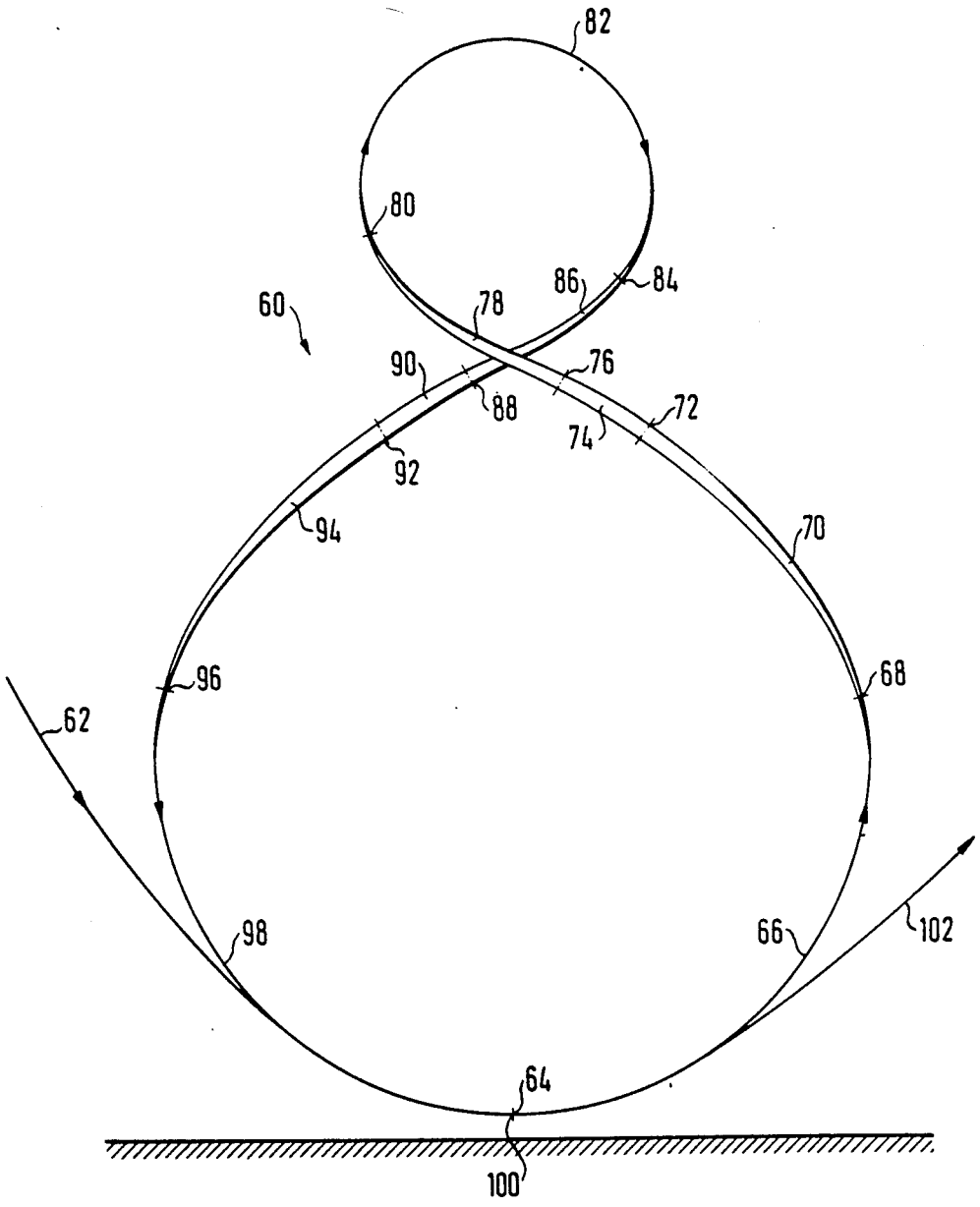
Figure 4:
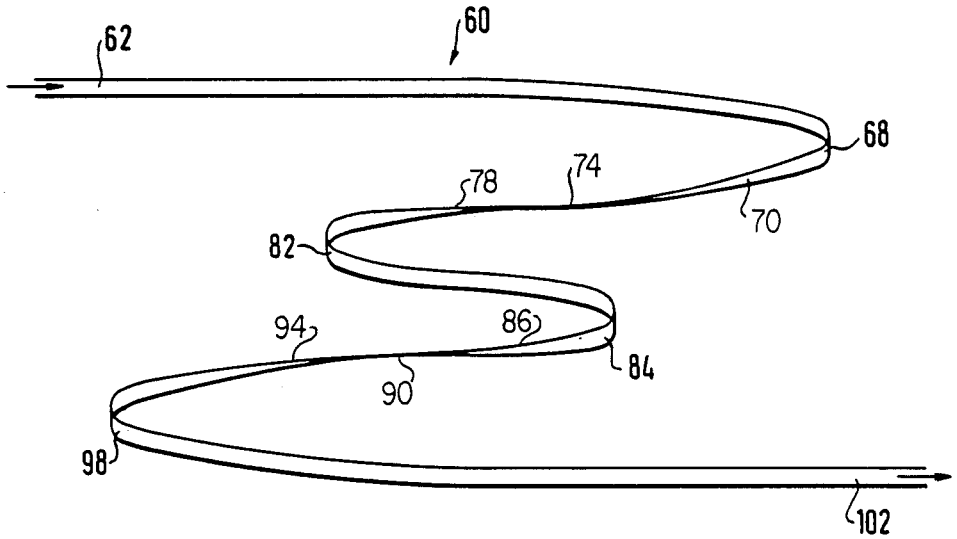

As an alternative to this it is also possible to position the two rollover stretches vertically over each other, by means of which a standing digit "Eight" results, as is shown in the FIGS. 3 and 4.

With this track system generally shown by the reference number 60 the tracks run, starting with the highest point of the acceleration stretch (not shown) which has approximately a height of 50m, towards a curved drop stretch 62 until the lowest point 64, at which the vehicles reach a speed of approximately 100 km/h.

The tracks mounted in the normal manner on steel supports (not shown) run from this lowest point 64 on a circular arc piece 66 upwardly towards a point 68, at which a first helical section 70 begins. The helical section 70 is defined by a clothoid with A=15. A straight stretch 74 lying in a vertical plane follows this first helical section 70 with the beginning point at 72 and the end at 76, which is followed by a second helical section 78. This helical section 78 is defined by a clothoid with A=7 and ends at a point 80 where the second helical section 78 transfers into a rollover stretch 82. At the highest point of the rollover stretch 82 hence the heads of the passengers are pointed downwardly. The rollover stretch 82 ends at a position 84 where again a first helical section 86 begins which is defined by a clothoid with A=7. A straight stretch 90 lying in a vertical plane follows this first helical section 86 with a drop with the beginning point at 88 and the end at 92, which is again followed by a second helical section 94. The second helical section 94 is defined by a clothoid with A=15. The end of the helical section 94 is shown by the reference number 96.

Thereafter a further circular arc piece 98 follows which passes through the lowest point 100 and transfers then into the coasting section 102, from which the vehicles are again brought back to the highest point of the acceleration stretch.

In the side view the track system 60, as according to FIG. 3, has the form of a vertical digit "Eight", in which a smaller circle with a radius of about 6 m is positioned on a larger circle with a relatively large diameter (in the embodiment shown the "crossing point" lies at approximately 32 m above the lowest point 64). The highest point of the track system 60 would thus lie at about 45 m over the lowest point.

As can be seen from the top view as according to FIG. 4, the two straight stretches 74 and 90 lying in a vertical direction have a minor curvature in a horizontal direction, by means of which, similarly as in the embodiment as according to FIGS. 1 and 2, pressing forces are produced which on the one hand hold the vehicles to the tracks and on the other hand hold the passengers to the seats of the vehicles.

I claim:

1. In a track system for a passenger-accomodating vehicle as a part of a rollercoaster comprising:

tracks which form (a1) an acceleration stretch, (a2) a rollover stretch consisting of several portions, in which the vehicle is rotated 180° around its lateral axis, (a3) two helical stretches in which the vehicle is rotated 180° around its longitudinal axis, and (a4) a coasting stretch, wherein the individual portions of the rollover stretches and the two helical stretches are arranged such that the shape of the digit "Eight" results in a vertical projection of the track system.

2. Track system according to claim 1, in which at the highest point of a first, semi-circular rollover stretch a first helical stretch follows, that a second, semi-circular rollover stretch follows the first helical stretch, and that the second rollover stretch transfers into a second helical stretch, by means of which the form of a lying digit "Eight" results in a vertical projection of the track system.

3. Track system according to claims 2, in which a first helical section, a dropping straight stretch lying in a vertical plane and a second helical section, which all form jointly the first or second helical stretch, respectively, all follow after the highest point of each rollover stretch.

4. Track system according to claim 3, in which the straight stretches are curved in a horizontal direction.

5. Track system according to claim 3, in which the radii of curvature of the helical sections vary in accordance with a clothoid.

6. Track system according to claim 1, in which the tracks run from the lowest point on a circular-arc piece upwardly to a point at which a first helical stretch begins which transfers into a circular rollover stretch, and that after the rollover stretch a second helical stretch and a further circular-arc piece follows, by means of which the form of a standing digit "Eight" results in a vertical projection of the track system.

7. Track system according to claim 6, in which the two helical stretches are formed by a first helical section, by a straight stretch lying in a vertical plane and by a second helical section.

8. Track system according to claim 7, in which the straight stretches are curved in a horizontal direction.

9. Track system according to claim 7, in which the radii of curvature of the helical sections vary in accordance with a clothoid.

10. A track system for a passenger-accomodating vehicle as part of a rollercoaster comprising:

tracks which form an acceleration section, a rollover stretch consisting of several portions, in which the vehicle is rotated about its lateral axis, two helical stretches in which the vehicle is rotated around its longitudinal axis, two circular-arc pieces, and a coasting stretch, wherein the track runs from the lowest point on the first circular-arc piece upward to a point at which a first helical stretch begins which transfers into a circular rollover stretch, and after the rollover stretch a second helical stretch and a second circular-arc piece follows, the individual portions of the rollover stretches, the two helical stretches and the circular-arc pieces are arranged to form a standing digit "Eight" in a vertical projection of the track system.

11. Track system according to claim 10, in which the two helical stretches are formed by a first helical section, by a straight stretch lying in a vertical plan and by a second helical section.

12. Track system according to claim 11, in which the straight are curved in a horizontal direction.

13. Track system according to claim 11, in which the radii of curvature of the helical sections vary in accordance with a clothoid.

14. A track system for a passenger-accomodating vehicle as a part of a rollercoaster comprising:

tracks which form an acceleration stretch, a rollover stretch consisting of several portions, in which the vehicle is rotated around its lateral axis, two helical stretches in which the vehicle is rotated around its longitudinal axis, each of said helical stretches being formed by a first helical section, a straight section lying in a vertical plane and a second helical section, said straight stretch lying in between said first and second helical sections, and a coasting stretch, wherein the individual portions of the rollover stretches and the two helical stretches are arranged such that the shape of a digit "Eight" results in a vertical projection of the track system.

* * * * *